United States Patent [19]

Dewey

[11] 3,948,442

[45] Apr. 6, 1976

[54] APPARATUS AND METHOD FOR MAKING SNOW WITH UNIFORM DROP SIZE

[75] Inventor: Gordon C. Dewey, New York, N.Y.

[73] Assignee: Hedco, Inc., Paramus, N.J.

[22] Filed: Sept. 30, 1974

[21] Appl. No.: 510,423

[52] U.S. Cl. ..... 239/2 S

[51] Int. Cl.[2] ..... A01G 15/00; E01H 13/00

[58] Field of Search ..... 239/2 S, 14

[56] References Cited

UNITED STATES PATENTS

| | | | |
|---|---|---|---|
| 3,257,815 | 6/1966 | Brocoff et al. | 239/2 S |
| 3,703,991 | 11/1972 | Eustis et al. | 239/2 S |
| 3,716,190 | 2/1973 | Lindlof | 239/2 S |
| 3,762,176 | 10/1973 | Coggins, Jr. | 239/2 S |
| 3,774,842 | 11/1973 | Howell | 239/2 S |

*Primary Examiner*—Lloyd L. King

*Attorney, Agent, or Firm*—Richard L. Stevens

[57] ABSTRACT

An airless snow-making machine is provided in which ice nuclei and water drops are formed separately, commingled, and discharged to form snow-like crystals. The water drops are uniform and are formed by cyclically disturbing linear water streams discharged from an orifice plate of a nozzle assembly. The cyclic disturbance effects the breaking off of water drops of uniform size from the fluid streams.

13 Claims, 4 Drawing Figures

APPARATUS AND METHOD FOR MAKING SNOW WITH UNIFORM DROP SIZE

BACKGROUND OF THE INVENTION

Snowmaking machines commonly fall into two basic categories: air systems which employ a combination of compressed air and water passing through a single nozzle, and so-called airless systems, which do not have a requirement of compressed air or use only relatively small amounts of compressed air to generate ice nuclei. Regardless of which system is used, certain problems are inherent in the manufacture of snow. Downstream of the discharge section of a snow-making machine, inevitably a wet spot will occur, which is caused by water droplets are not suspended in the air long enough to crystallize into snow. The second problem is that in some instances a portion of the snow-ice-plume discharged from a snowmaking machine will remain airborne and drift outside the desired area for deposition of snow.

I have determined after a careful analysis that the drop size distribution produced by the water nozzles used in the manufacture of snow is the most important contributing factor to these problems. Basically, in the plume discharged from a snow-making machine, there is a wide distribution in drop size. The large drops, because of their weight, tend to fall out of the wake stream subsequent to discharge and fall on the ground, causing the wet spots immediately downstream of the snow-making machine. The small drops remain airborne for a considerably longer period of time than is necessary to form snow and tend to fall to the ground far outside the desired area. This problem is particularly acute in those airless systems which employ the movement of large volumes of air to project the snow onto the area to be covered or in compressed air systems employing water only nozzles to add more water spray to the basic pneumatically atomized stream.

The water nozzles commercially used today in airless systems rated for a particular drop size in fact provide a wide distribution of drop sizes for any given fluid pressure and orifice size. This is generally true whether pressure, spinning disk, or pneumatic atomization is employed. Thus, even if an optimum drop size is desired for the operation of a particular snow-making machine, the use of commercially available nozzles will not solve the aforementioned problems because of the inherent wide variance in drop size.

SUMMARY OF THE INVENTION

My invention relates to a method and apparatus for providing substantially uniform drop sizes for formation of snow. More particularly, my invention is directed to the formation of uniform drops within a predetermined range for use in an airless snow-making system.

In the preferred embodiment of my invention, a method and apparatus is provided wherein drops of substantially uniform size are formed separately from the formation of an ice nuclei cloud as disclosed in U.S. Pat. No. 3,567,117. By uniform drop size it is meant that more than 70 percent, for example, up to 90 percent of the drops discharged from the orifices of the nozzles used in my invention are within ±25 percent, preferably within ±10 percent of a predetermined length mean diameter (LMD).

In one embodiment of the invention, uniform drops from a nozzle(s) are generated by superimposing a signal on a fluid stream. More particularly, an alternating signal is superimposed on a generally linear fluid stream discharged from an orifice at a particular chosen frequency to cause the fluid stream to break into uniform drops (Rayleigh Breakup). This cyclic disturbance of the fluid stream is preferably effected by an alternating pressure variation at a fixed frequency. Alternatively, the fluid stream may be uniformly broken by passing the stream through an orifice where the diameter may be varied as in an iris or shutter.

The method of my invention includes flowing at least one fluid stream through an orifice plate, disturbing cyclically in a uniform manner the fluid stream passing through an orifice in the orifice plate to provide drops of a predetermined size, discharging the water drops so formed into the surrounding environment and cooling the drops to a temperature of less than 0°C and commingling the uniformly formed water drops with ice nuclei, whereby snow-like crystals are formed.

The apparatus of my invention includes at least one nozzle having an orifice to discharge a fluid stream therethrough, means to provide a cyclic disturbance to the fluid stream discharged from the orifice such that the stream is broken into substantially uniform drops, means to form ice nuclei and means to discharge the ice nuclei and uniformly formed water drops into the atmosphere.

DESCRIPTION OF THE PREFERRED EMBODIMENT(S)

Figure 2:
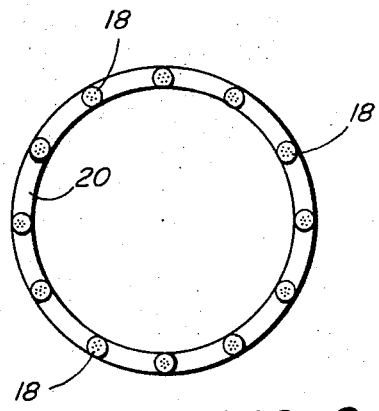
FIG. 2 is a front view of the nozzle array of FIG. 1.
Figure 1:
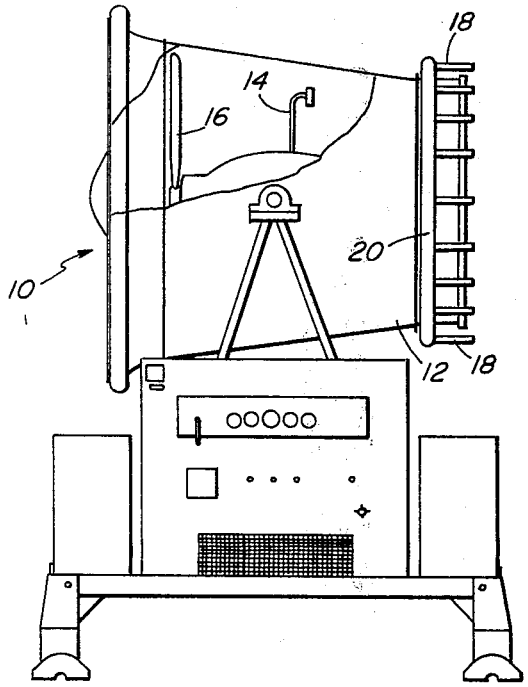
FIG. 1 is a front partially fragmentary view of a snow-making machine employed in the preferred embodiment of the invention.

As disclosed in U.S. Pat. Nos. 3,733,029 and 3,703,991, hereby incorporated by reference in this application in their entireties, water droplets and ice nuclei for the formation of snow are separately formed. The nuclei and droplets are subsequently mixed and discharged into the air stream to form snow-like crystals. Referring to FIG. 1, a snow-making machine 10 is shown having a housing 12, partly broken away. Nucleating nozzles 14 (one shown) to form ice nuclei are secured within the housing downstream of a propeller 16 for the movement of an airstream through the housing 14. Further, the nucleating nozzles 14 are upstream of an array of nozzles 18 for the formation of water droplets. The nuclei generated by the nozzles 14 are mixed with the separately formed water droplets and carried by the wake stream created by the propeller 16. The nozzles 18 are connected to a manifold 20 as shown in FIG. 2.

In presently available commercially rated nozzles for pressure, pneumatic, or spinning disk fluid atomization, there is a wide variance in drop size. Typically 15 percent of the drops (44 weight percent of the total product) will be two times as large as the LMD and another 20 percent (7.5 weight percent of the total product) will be one half as large as the LMD. The adverse effects of such drop size variation on the snow-making process is compounded because (1) big drops take much more time to freeze and (2) big drops fall through the air faster so that in any given situation they have much less time to freeze before falling to the ground.

Table I shows for drops of diameters of 0.1 mm, 0.2 mm, 0.4 mm, 0.8 mm, and 1.0 mm (1) the approximate length of time to freeze in seconds when falling at terminal velocity; (2) the approximate terminal velocity of the drop falling through air; and (3) the required equivalent height to which a drop must be projected so that it will freeze completely while falling to the ground at its terminal velocity.

TABLE I

| Drop Size Millimeter | (1) Time to Freeze (seconds) | (2) Terminal Falling Velocity (ft/sec) | (3) Equivalent Required Height to Freeze (feet) |
|---|---|---|---|
| 0.1 | 1.14 | .82 | .935 |
| 0.2 | 3.36 | 2.33 | 7.85 |
| 0.4 | 8.74 | 5.50 | 48.00 |
| 0.8 | 21.0 | 10.66 | 224.00 |
| 1.0 | 27.5 | 13.22 | 365.00 |

In the foregoing Table I, the water drops are at 32°F and the ambient conditions have been assumed to be 23°F temperature and 50 percent relative humidity. For colder and drier ambients, drops freeze faster, but even at 0°F and 50 percent relative humidity, a 1 mm diameter drop requires approximately 10 seconds to freeze and a projected height of 110 feet.

In a typical snow-making situation, the water particles are projected into the air at an elevation angle of 45° to a height of 40 feet from where they fall out of the wake stream to the ground, at a distance of 40 feet from the projector. In such circumstances, a 0.4 mm drop will reach the ground nearly completely frozen, while an 0.8 mm drop will be only approximately 25 percent frozen. The latter case is quite undesirable in snow-making as the unfrozen water content of the big drops causes excessive wet spots and icing.

Similarly, smaller drops, 0.2 mm in diameter, will fall to the ground from a 40 feet height in 17 seconds. Such a length of time is ample to completely freeze the 0.2 mm drops. However, even a gentle breeze of 6 miles per hour (9 ft/sec) will carry such a drop 150 feet from the place where the drop falls out of the wake stream, or 190 feet approximately from the projector. Generally, snow-making operations require the deposition of snow in the range of 25 to 100 feet from the projector; as a practical matter such small drops will be carried outside the useful area of snow deposition and will therefore be wasted.

The foregoing analysis indicates that drops substantially in excess of 0.4 mm diameter are extremely undesirable in snow-making and drops less than 0.2 mm in diameter will tend to be wasted. The transition from (1) the deposition of substantially unfrozen drops to (2) the generation of drops that will be carried away and wasted by even gentle winds, is quite narrow; a range of ±25 percent in drop size will cause substantial inefficiency and/or undesirable wet spots. When uniform drops are formed by cyclically disturbing a fluid stream discharged from an orifice, the snow-making process may be adjusted for much higher capacity.

Figure 3:
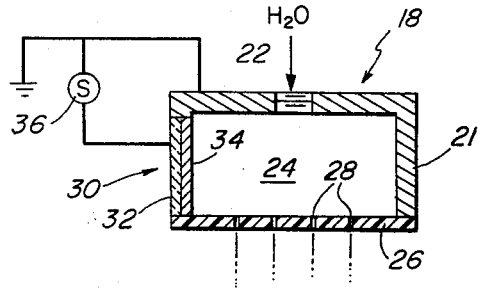
FIG. 3 is a side sectional view of a nozzle of the preferred embodiment.

In the present invention, the uniform drops are provided by the nozzles 18. Referring to FIG. 3, the nozzle

18 includes a cylindrical housing 21 with an inlet 22 for the flow of water into a chamber 24 from the manifold 20 and an orifice plate 26 having a plurality of conical shaped orifices 28 therein. Other shaped orifices may be used, such as venturi orifices, as long as a substantially uniform fluid stream is emitted from the orifice plate under the flow rates and pressures employed. A transducer 30, which comprises a single disc of piezoelectric ceramic 32 bonded to a 0.010 inch brass wafer 34 is secured to the housing 21 forming a portion of the wall of the chamber 24. An oscillator 36 electrically communicates with the transducer 30. The power and frequency range will vary depending upon operating conditions. The electrical components are connected to a suitable power supply. Other devices may be used to generate the frequency, such as a trumpet driver and transducer or diaphragm. Also, the power may be increased by an amplifier if the oscillator itself does not have enough power. The frequency applied to the transducer 30 creates pressure pulses in the chamber 24, which pulses are transmitted to the fluid streams emerging from the orifice plate 26. Thus, a cyclic disturbance in the form of an alternating signal is transmitted through a fluid medium (water) and breaks the fluid stream into uniform droplets.

In the operation of the snow-making machine 10, the propeller 16 creates a wake stream and the ice nuclei and water droplets are commingled as described in the aforementioned patents.

Depending upon atmospheric conditions, the flow rates and temperature of the fluids flowing through the nucleating nozzles 14, the nozzles 18 and the thrust provided by the propeller 16; the optimum drop size for efficient snow formation will vary. Generally, a drop size in the range of from 300 to 400 microns is desired, such as from 300 to 360 microns. Smaller drops tend to stay airborne and larger drops fall from the wake stream prematurely. Preferably, 360 micron drops are suitable, but under certain conditions drops as large as 600 microns may be effective. The drop size dimension used refers to the length mean diameter (LMD) as employed in spray technology.

In the preferred embodiment, the orifice plate 26 includes orifices having a diameter of approximately 184 microns, such that the fluid streams discharged therefrom will form droplets of about 360 microns when the proper frequency is applied by the oscillator 36. The orifices are spaced to insure that the fluid streams do not mix and that the drops formed maintain their dimensional integrity. The relationship between frequency applied, flow rates, pressure, and diameter of the discharged fluid streams for this type of nozzle are discussed in *Induced Cyclic Disturbance Thin-Plate Multiple-Orifices Nozzles*, Paper No. 72-642, Bouse et al., American Society of Agricultural Engineers, December, 1972; which is hereby incorporated by reference in its entirety in this application. Thus, with a pressure in the chamber of 100 psig and orifice diameter of 184 microns jet streams having a flow rate of 0.91 cc per second per each orifice are discharged from the orifice plate. Based on these values, a frequency of 34 Khz to 38 Khz is applied to the transducer 32 to provide pulsed vibrations in the chamber 24. These pulsed vibrations are transmitted to the fluid streams discharged from the orifice plate 26 as a cyclic disturbance such that the fluid streams will break into uniform drops of approximately 360 microns. As many as 500–1000 individual orifices may be embodied in a single orifice plate generating a flow of 7 to 14 gallons per minute per nozzle at a pressure of 100 psig. Thus, with the present invention, uniform drops varying not more than ±10 percent from the LMD and comprising 90 percent of the total amount of drops formed are provided for snow-making purposes. This insures that the maximum amount of drops are thus available for nucleation and snow formation and will be carried in the wake stream for a sufficient time such that they fall to the ground as snow-like particles. Larger drops are avoided, eliminating the problems of wetting, and smaller drops are also avoided, eliminating the waste of snow falling outside the desired area.

Figure 4:
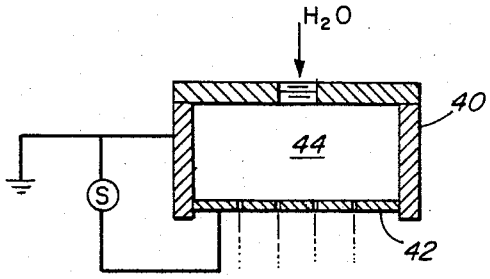
FIG. 4 is a side sectional view of an alternative nozzle embodiment.

An alternate nozzle is shown in FIG. 4. A housing 40 includes an orifice plate 42 and a chamber 44. An alternating signal is applied directly to the plate 42 by an oscillator 44. The plate 42 is dimensioned such that it vibrates when the signal is applied. The vibrations are transmitted to the discharged fluid streams, effecting their break-up into uniform drops.

Although the formation of uniform drops has been described in combination with a particular airless snow-making machine, it should be understood that the principle may be employed with other airless snow-making machines and air snow-making machines such as those which use pneumatic atomization supplemented by pressure atomized water sprays.

Further, the cyclic disturbance has been described in reference to providing pulses to a fluid chamber at a particular frequency, whereby the fluid streams flowing through an orifice plate from the chamber are broken off by a defined cyclic disturbance. It should be understood that other types of cyclic disturbances on fluid streams may be used to modulate the streams emerging from the plate at the proper wave length to induce the uniform formation of drops.

Having described my invention, what I now claim is:

1. A method for the formation of snow, which includes:

a. providing substantially uniform water drops, more than 70 percent of the drops formed of a size within +25 percent of a predetermined length mean diameter, by:

i. discharging water from an orifice as a fluid stream; and ii. disturbing cyclically the fluid stream emerging from the orifice to form uniform drops;

b. cooling the water drops to below 0°C;

c. commingling the water drops with ice nuclei to form a nuclei water droplet mixture; and d. discharging the mixture into the atmosphere to form snow-like crystals.

2. The method of claim 1, wherein the fluid streams are disturbed cyclically by:

flowing the water into a nozzle chamber prior to its discharge from the orifice; and applying an alternating signal to the chamber whereby the fluid stream discharged from the orifice breaks up into uniform drops.

3. The method of claim 1 wherein the orifice is disposed in an orifice plate; and which includes disturbing cyclically the orifice plate to vibrate said plate whereby the fluid stream is broken into uniform drops.

4. The method of claim 1 which includes forming ice nuclei in a first zone and the water drops are provided in a second zone spaced apart from the first zone.

5. The method of claim 4, which includes flowing the water through a nozzle chamber;

discharging the water from the chamber as fluid streams; and disturbing cyclically the fluid streams emerging from the chamber by superimposing an alternating signal thereon.

6. The method of claim 5 which includes providing a signal at a predetermined frequency and applying said signal to the fluid streams.

7. A method for the formation of snow which includes:

a. providing substantially uniform water drops in a first zone by:

i. discharging water from an orifice as a fluid stream; and ii. disturbing cyclically the fluid stream emerging from the orifice to form uniform drops;

b. cooling the water drops to below 0°C;

c. forming ice nuclei in a second zone spaced apart from the first zone;

d. commingling the water drops formed with the ice nuclei to form a water-nuclei mixture; and e. discharging the mixture into the atmosphere to form snow-like crystals.

8. The method of claim 7 wherein the orifice is disposed in an orifice plate and includes disturbing cyclically the orifice plate to vibrate the plate whereby the fluid stream is broken into uniform drops.

9. The method of claim 7 wherein the fluid stream is disturbed cyclically by:

flowing the water into a nozzle chamber prior to its discharge from the orifice; and applying an alternating signal through the chamber whereby the fluid stream discharged from the orifice breaks up into uniform drops.

10. The method of claim 9 which includes disturbing cyclically the fluid stream emerging from the chamber by superimposing an alternating signal thereon.

11. The method of claim 10 which includes providing a signal at a predetermined frequency and applying said signal to the fluid stream.

12. The method of claim 7 wherein more than 90 percent of the drops formed are of a size within ±10% of a predetermined length mean diameter.

13. The method of claim 7 wherein the length mean diameter of the uniform water drops is between about 200–600 microns.

* * * * *

UNITED STATES PATENT OFFICE

CERTIFICATE OF CORRECTION

Patent No. 3,948,442 Dated April 6, 1976

Inventor(s) Gordon C. Dewey

It is certified that error appears in the above-identified patent and that said Letters Patent are hereby corrected as shown below:

Column 5, line 44, "+25 percent of a predetermined length mean diam-" should read -- ±25 percent of a predetermined length mean diam-. --.

Signed and Sealed this

Thirteenth Day of July 1976

[SEAL]

*Attest:*

RUTH C. MASON
*Attesting Officer*

C. MARSHALL DANN
*Commissioner of Patents and Trademarks*